US008579391B2

(12) United States Patent
Pohu

(10) Patent No.: US 8,579,391 B2
(45) Date of Patent: Nov. 12, 2013

(54) ARTICLE HANDLING MACHINE EQUIPPED WITH A TILTABLE ELECTRICAL CABINET

(75) Inventor: Cédric Pohu, Octeville-sur-Mer (FR)

(73) Assignee: Sidel Participations, Octeville sur Mer (FR)

( * ) Notice: Subject to any disclaimer, the term of this patent is extended or adjusted under 35 U.S.C. 154(b) by 324 days.

(21) Appl. No.: 12/934,598

(22) PCT Filed: Mar. 27, 2008

(86) PCT No.: PCT/IB2008/001225

§ 371 (c)(1),
(2), (4) Date: Dec. 20, 2010

(87) PCT Pub. No.: WO2009/118578

PCT Pub. Date: Oct. 1, 2009

(65) Prior Publication Data

US 2011/0084582 A1 Apr. 14, 2011

(51) Int. Cl.
*A47B 81/00* (2006.01)

(52) U.S. Cl.
USPC ..... 312/278; 312/249.7

(58) Field of Classification Search
USPC ..... 312/249.7, 278–279, 317.1, 300, 312/140.3–140.4, 196
See application file for complete search history.

(56) References Cited

U.S. PATENT DOCUMENTS

| | | | | |
|---|---|---|---|---|
| 2,192,862 | A * | 3/1940 | Eagley | 222/36 |
| 2,840,435 | A * | 6/1958 | Campbell | 312/279 |
| 3,605,768 | A | 9/1971 | Golding | |
| 4,268,098 | A * | 5/1981 | Kretchman et al. | 312/210 |
| 5,013,240 | A * | 5/1991 | Bailey et al. | 433/77 |
| 5,229,913 | A | 7/1993 | Smith | |
| 5,738,424 | A * | 4/1998 | Katz et al. | 312/293.3 |
| 6,119,678 | A * | 9/2000 | Marchand | 126/39 B |
| 6,351,924 | B1 | 3/2002 | Gustafsson et al. | |
| 6,739,681 | B1 * | 5/2004 | Sharrow | 312/327 |

FOREIGN PATENT DOCUMENTS

DE 196 42 987 A1 4/1998

* cited by examiner

*Primary Examiner* — Hanh V Tran
(74) *Attorney, Agent, or Firm* — Sughrue Mion, PLLC

(57) ABSTRACT

Article handling machine (1) having a frame (3) for receiving article handling elements, a roof (7) covering said frame (3), and an electrical cabinet (12) for receiving devices for controlling electrical power supplied to said handling elements, characterized in that the electrical cabinet (12) is pivotally mounted on the roof (7) between an erected position in which the cabinet (12) is substantially perpendicular to the roof (7) for allowing an operator to access inside the cabinet (12) in standing posture, and a lying position in which the cabinet (12) extends substantially parallel to the roof (7).

14 Claims, 3 Drawing Sheets

Fig.3
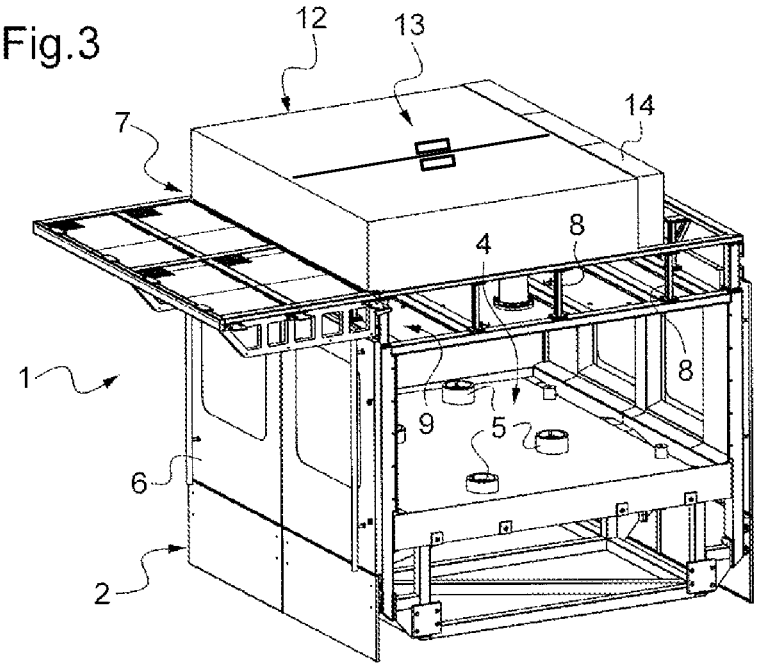
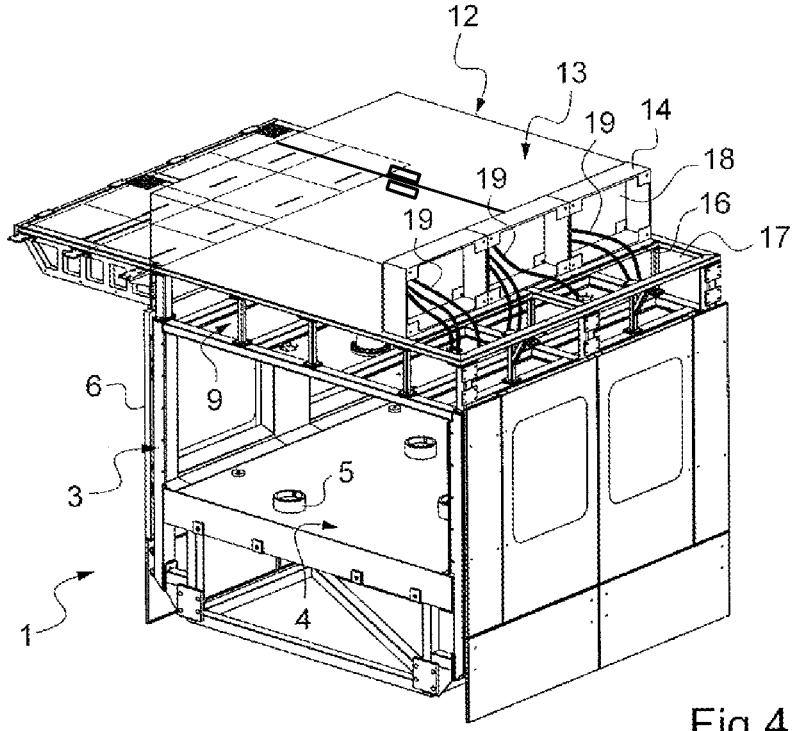
Fig.4

ARTICLE HANDLING MACHINE EQUIPPED WITH A TILTABLE ELECTRICAL CABINET

CROSS REFERENCE TO RELATED APPLICATIONS

This application is a National Stage of International Application No. PCT/IB2008/001225, filed on Mar. 27, 2008, the contents of all of which are incorporated herein by reference in their entirety.

FIELD OF THE INVENTION

The invention relates to article handling machines, and more specifically to the supplying of electrical power to article handling machines.

BACKGROUND OF THE INVENTION

In article handling machines, handling elements (e.g. carrousels, transfer wheels) are generally driven by powerful electrical motors which require high voltage to be supplied to the machine.

In order to control the electrical power supplied to the handling devices, the machine is usually provided with an electrical cabinet receiving control devices. Electrical cables run through the electrical cabinet and are distributed, via cable trays, to the handling devices.

Such an electrical cabinet is generally positioned aside the machine, either at a distance therefrom, which is not convenient because cables running from the cabinet to the machine may obstruct passage for operators or motorized handling appliances, or adjacent to the machine, which is not convenient either because, in most applications, side walls of a handling machine should offer a free access for operators to the inner volume of the machine in order to allow maintenance operations. In practice, side walls of the handling machines are provided with windows which the operators may open manually to access the inner volume of the machine.

Furthermore, the mere presence of an electrical cabinet is problematic since the cabling must be dismounted for transportation of the machine from the workshop, in which setting operations are conducted, to the client's premises where the machine is re-built together with its cabling. Often the cable length is not the same in the workshop as in the client's premises, or the position initially provided is not suitable.

SUMMARY OF THE INVENTION

It is an object of the invention to provide an article handling machine including an electrical cabinet mounted in such a way to facilitate installation and/or dismounting operations.

The proposed article handling machine has a frame for receiving article handling elements, a roof covering said frame, and an electrical cabinet for receiving devices for controlling electrical power supplied to said handling elements. The electrical cabinet is pivotally mounted on the roof between an erected position in which the cabinet is substantially perpendicular to the roof for allowing an operator to access the cabinet in standing posture, and a lying position in which the cabinet extends substantially parallel to the roof.

In the lying position, the electrical cabinet may fully rest on the roof. In a preferred embodiment, the cabinet comprises a base by which it is pivotally mounted on the roof. In addition, a bottom of the electrical cabinet preferably has apertures to allow passage of electrical cables. Correspondingly, a roof portion of the machine (which may be spaced from the machine frame), receiving the electrical cabinet, may have apertures to allow passage of the electrical cables. The electrical cabinet may have a longitudinal edge by which it is hingedly fixed to the roof, e.g. to a roof beam. In such a case, doors of the cabinet may be provided on a side opposite the hinged edge.

The above and other objects and advantages of the invention will become apparent from the detailed description of preferred embodiments, considered in conjunction with the accompanying drawings.

BRIEF DESCRIPTION OF THE DRAWINGS

FIG. 3 is a view similar to FIG. 1 and FIG. 2, wherein the electrical cabinet is in its lying position.

FIG. 4 is a perspective view, of the article handling machine of FIG. 3, wherein the electrical cabinet is in its lying position, taken from another point of view.

DESCRIPTION OF PREFERRED EMBODIMENTS

Figure 1:
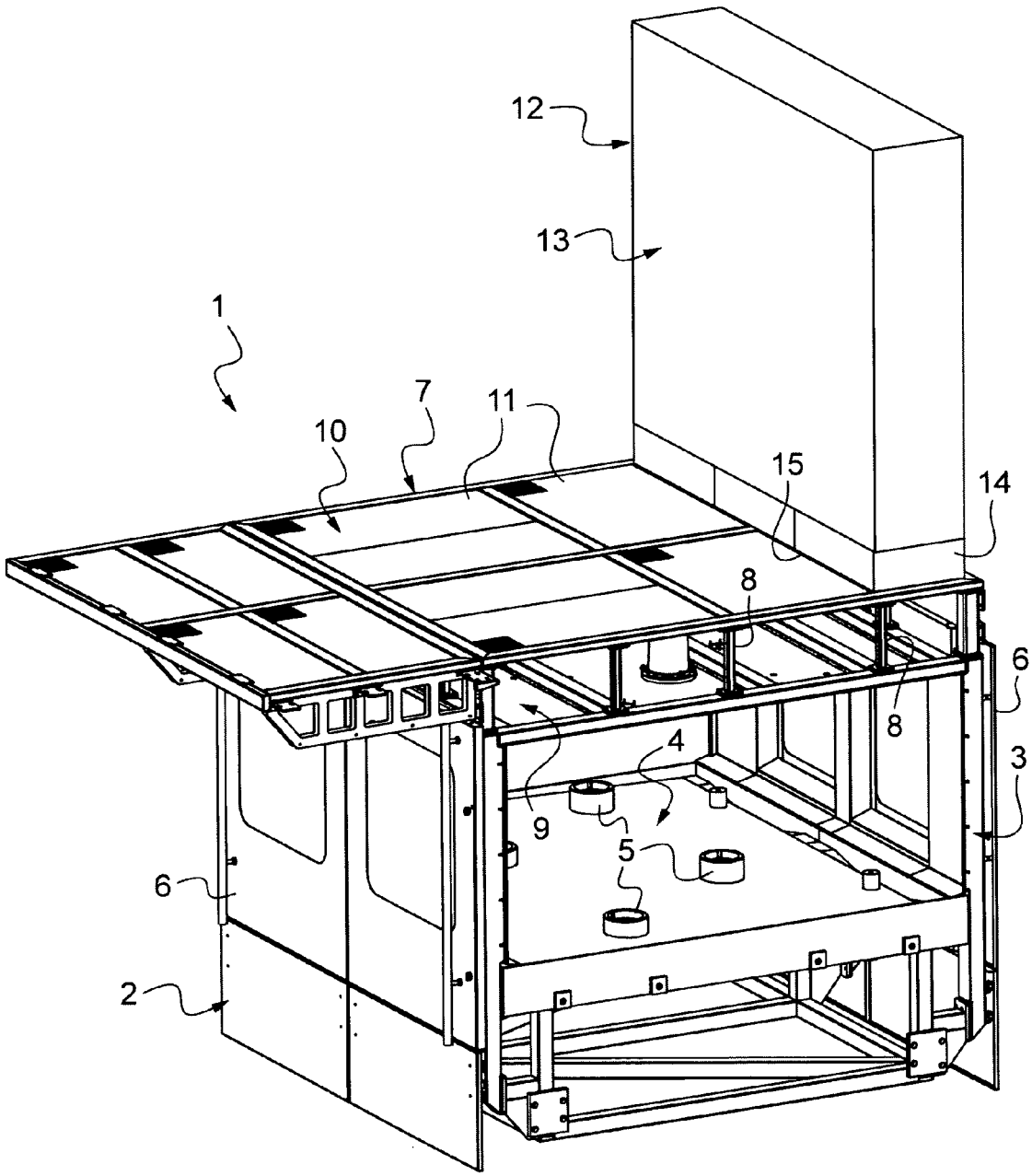
FIG. 1 is a top perspective view of an article handling machine according to the invention, provided with an electrical cabinet here shown in an erected position.

Turning now to the drawings, there is partly shown on FIG. 1 a machine 1 for handling articles such as containers. Nowadays, container handling machines are generally built in a modular way, whereby several adjacent modules are assembled and fixed to each other (e.g. by means of bolts) at the client's premises. One such module 2 is represented on FIG. 1. The machine 1 comprises a frame 3 including a table 4 provided with cylindrical barrels 5 for receiving rotary article handling elements such as star wheels pivotally mounted in the barrels 5.

The machine 1 comprises, on opposite lateral sides, windows 6 pivotally (or slidingly) mounted on the frame 3, and which an operator may manually open to access the article handling elements inside the machine 1 during setting or maintenance thereof.

As depicted on FIG. 1, the machine 1 comprises a roof 7 covering the frame 3. The roof 7 is fixed to the frame 3 by means of a plurality of posts 8 which maintain between the roof 7 and the frame 3 an upper space 9 wherein trays can be installed for the running and distribution, throughout the machine 1, of electrical cables linked to motors driving the article handling elements.

The roof 7 comprises a platform 10 on which an operator may walk to access different parts of the machine 1 for setting and/or maintenance purposes. The platform 10 may include several removable plates 11 allowing the operator to access the upper space 7 in order e.g. to install, remove or replace electrical cables.

As depicted on the drawings, the machine 1 further comprises an electrical cabinet 12 for receiving electric and/or electronic devices for controlling electrical power supplied to the handling elements via the electrical cables.

The electrical cabinet 12 is pivotally mounted on the roof 7 between:

an erected position (FIG. 1) in which the cabinet 12 is substantially perpendicular to the roof 7 for allowing the operator to access the cabinet 12 in standing posture, and a lying position (FIG. 3-4) in which the cabinet 12 extends substantially parallel to the roof 7.

The cabinet 12 comprises a body 13 including lateral walls and doors pivotally mounted thereto, and a base 14 onto which the body 13 is mounted and fixed. The base 14 has a longitudinal edge 15 along which it is hingedly fixed to a roof beam 16. As depicted on FIG. 4, both the portion of the roof supporting the electrical cabinet 12 and the bottom of the cabinet 12 (i.e. the base 14) have apertures 17, 18 allowing passage of electrical cables 19 from the inside of the cabinet 12 to the upper space 9, whichever the position of the cabinet 12. Of course, length of the electrical cables 19 will be sufficient to allow rotation of the cabinet 12 from its erected position to its lying position.

In a preferred embodiment depicted on FIG. 3-4, in the lying position the electrical cabinet 12 rests on the roof 7 in full contact therewith in order to minimize the overall height of the machine 1, whereas in alternate embodiments it may rest only partly on the roof 7 at a distance therefrom, e.g. by means of spacers.

Furthermore, in one preferred embodiment, doors of the cabinet 12 are provided on a side opposite the hinged edge 15 of the base 14, so that even in the lying position the doors of the cabinet 12 may be opened.

Figure 2:
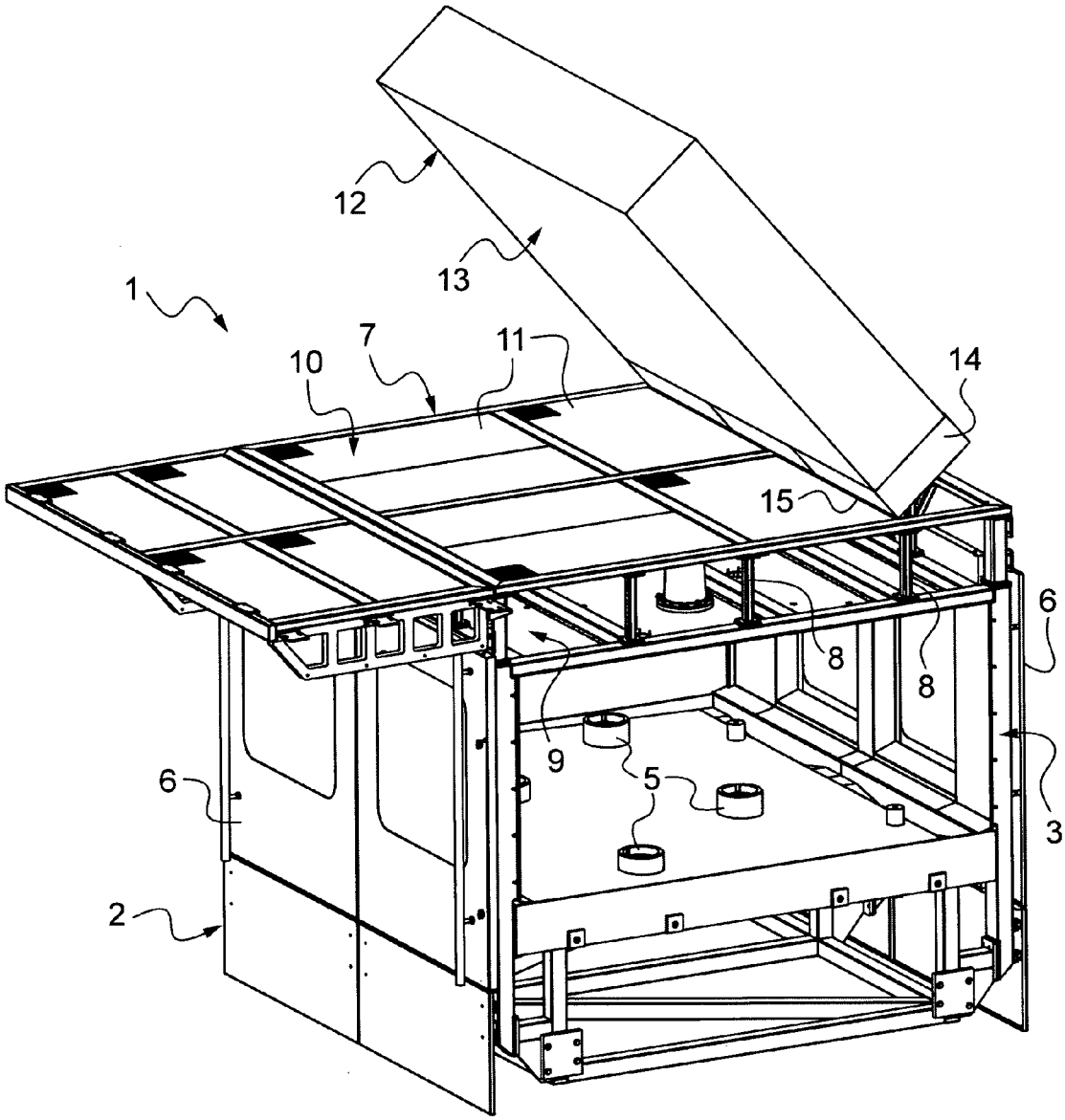
FIG. 2 is a view similar to FIG. 1, wherein the electrical cabinet is pivoted from its erected position to its lying position.

During setting of the machine 1, the electrical cabinet 12 is in its erected position (FIG. 1), so that operators walking on the roof can access in standing posture the inside of the cabinet 12 to install the appropriate electrical cables and devices therein. Once the electrical cabling is achieved and the machine 1 is ready for delivery to the final client, the electrical cabinet 12 is swivelled (FIG. 2) from its erected position to its lying position (FIG. 3-4), whereby the height of the machine 1 is minimized to allow easy transportation thereof. When the machine 1 is mounted again at the client's premises, the electrical cabinet 12 is swivelled back to its erected position, whereby the cabinet 12 is ready for use during the final settings of the machine 1 and further maintenance thereof.

The invention claimed is:

1. An article handling machine having a frame for receiving article handling elements, a roof covering said frame, and an electrical cabinet for receiving devices for controlling electrical power supplied to said handling elements, wherein the electrical cabinet is pivotally mounted on the roof between an erected position in which the cabinet is substantially perpendicular to the roof for allowing an operator to access inside the cabinet in standing posture, and a lying position in which the cabinet extends substantially parallel to the roof; wherein the roof comprises at least one plate secured to the frame that defines a platform on which an operator can walk to access different parts of the machine for at least setting or maintenance purposes.

2. The article handling machine according to claim 1, wherein the cabinet comprises a base by which the cabinet is pivotally mounted on the roof.

3. The article handling machine according to claim 1, wherein a bottom of the electrical cabinet has apertures to allow passage of electrical cables.

4. The article handling machine according to claim 3, wherein a roof portion receiving the electrical cabinet has apertures to allow passage of the electrical cables.

5. The article handling machine according to claim 1, wherein the electrical cabinet has a longitudinal edge by which it is hingedly fixed to the roof.

6. The article handling machine according to claim 5, wherein the electrical cabinet is hingedly fixed to a roof beam.

7. The article handling machine according claim 5, wherein the electrical cabinet has doors on a side opposite the hinged edge.

8. The article handling machine according to claim 1, wherein the roof is spaced from the machine frame.

9. The article handling machine according to claim 1, wherein in the lying position the electrical cabinet fully rests on the roof.

10. The article handling machine according to claim 1, wherein the roof is fixed to the frame by a plurality of posts that maintain between the roof and the frame an upper space.

11. The article handling machine of claim 1, wherein said at least one plate comprises a plurality of removable plates.

12. An article handling machine, comprising:

a deck;

a frame for receiving article handling elements on the deck;

a roof covering the deck; and an electrical cabinet containing controls;

the electrical cabinet is pivotally mounted between an erected position in which the electrical cabinet is substantially perpendicular to the roof for allowing an operator to access inside the electrical cabinet while standing, and a lying position in which the electrical cabinet extends substantially parallel to the roof; and wherein the roof comprises at least one plate secured to the frame that defines a platform on which an operator can walk to access different parts of the machine for at least setting or maintenance purposes.

13. The article handling machine of claim 12, wherein the deck comprises cylindrical barrels configured to receive rotary article handling elements, including star wheels pivotally mounted in the barrels.

14. The article handling machine of claim 12, wherein said at least one plate comprises a plurality of removable plates.

* * * * *